United States Patent [19]

Hickey

[11] 4,261,401

[45] Apr. 14, 1981

[54] STORAGE CONTAINERS FOR VEHICLES OR OTHER GOODS

[75] Inventor: Christopher D. D. Hickey, Esher, England

[73] Assignee: Airflex Containers Limited, Ashford, England

[21] Appl. No.: 107,080

[22] Filed: Dec. 26, 1979

[30] Foreign Application Priority Data

Jan. 4, 1979 [GB] United Kingdom ..... 00391/79

[51] Int. Cl.[3] ..... B65D 51/16

[52] U.S. Cl. ..... 150/52 K; 206/524.8

[58] Field of Search ..... 150/52 K, 52 R , 2, 150/3; 206/524.8

[56] References Cited

U.S. PATENT DOCUMENTS

| | | | |
|---|---|---|---|
| 2,243,981 | 6/1941 | Rowan | 150/52 K |
| 3,929,178 | 12/1975 | Hickey | 150/52 K |
| 4,028,853 | 6/1977 | Hickey | 52/2 |
| 4,114,668 | 9/1978 | Hickey | 150/52 R X |

*Primary Examiner*—Donald F. Norton

*Attorney, Agent, or Firm*—Young & Thompson

[57] ABSTRACT

In a container for a vehicle or other goods comprising an impermeable base, an impermeable cover and means for sealing the cover to the base, so that, by evacuation of air from the region within the cover, the latter is drawn down onto the vehicle or other goods on the base, provision is made for obtaining access to the vehicle or other goods without removing the cover. For this purpose the cover has an opening which is sealed by means of an inflatable tube forcing the lips of the opening tightly together. Inflatable tubes lift and support the cover when access is required.

8 Claims, 3 Drawing Figures

STORAGE CONTAINERS FOR VEHICLES OR OTHER GOODS

BACKGROUND OF THE INVENTION

1. Field of the Invention

This invention relates to containers for vehicles or other goods in which a flexible impermeable cover is sealed over the vehicle or other goods to be stored so that, by evacuation of air from the region inside the cover, the cover is drawn down tightly onto the vehicle or other goods.

2. Prior Art

Containers of this nature for storage of vehicles are described for example in U.S. Pat. Nos. 3,815,650 and 3,929,178. Such containers are used where it may be necessary to store a vehicle for a long time in conditions such that the vehicle is immediately ready for use when the cover is taken off the container. For example such containers may be used for military vehicles. Containers of this nature are commonly employed for storing vehicles in the open and the cover therefore must provide protection against the weather. It is necessary therefore to use a strong material which remains impermeable despite exposure to sunlight or other weather conditions. Commonly the cover is made of a thick butyl rubber. Such a cover can be sealed to an impermeable base on which the vehicle stands and will retain vacuum tightness over very long periods. If the vehicle is required for use, air is admitted into the container, a suitable valve being provided for this purpose and the cover is then unsealed and removed. If an inflatable tubular seal is used for sealing the cover to the base, as for example is described in the aforementioned U.S. Pat. Nos. 3,815,650 and 3,929,178, then the seal around the base of the cover may readily be released. Although the cover is heavy, it is readily possible to remove it quite quickly from a vehicle. Putting the cover on however requires the making of an efficient seal between the cover and the base, for example by tucking an inflatable tube, which extends around the periphery of the cover, into a channel around the base. This requires considerable effort because of the weight of the cover.

SUMMARY OF THE INVENTION

It is an object of the present invention to provide an improved form of container in which access may be obtained to a stored vehicle or other goods without having to remove the cover or to break the seal between the cover and the base. Such access may be desirable for inspection purposes or to effect modifications or changes to the stored vehicle.

According to the present invention, a container for a vehicle or other goods comprises an impermeable base, an impermeable flexible cover, means for sealing the cover around its periphery to said base, and means for evacuating air from the region within said cover, said cover furthermore having an opening in the form of a slit with an inflatable tube arranged for sealing the two sides of the slit together. Preferably the sides of the slit are formed as lips which are pressed together by said inflatable tube. Conveniently the two lips are inserted into a rigid holder for the inflatable tube so that they are compressed between the tube and a rigid part of the holder when the tube is inflated. However, in some cases, it may be convenient to use a flexible seal such as is described and claimed in U.S. Pat. No. 4,028,853.

When the access is obtained to the vehicle or other goods, by releasing the pressure in the inflatable seal and opening the slit, air enters the container and the cover will rest on the vehicle or goods in the container. It may be desirable to hold up or lift the cover or part of the cover and, for this purpose, one or more inflatable tubes of flexible material may be provided inside the cover, the tube or tubes being inflatable to form a rigid framework.

DESCRIPTION OF THE PREFERRED EMBODIMENT

Figure 1:
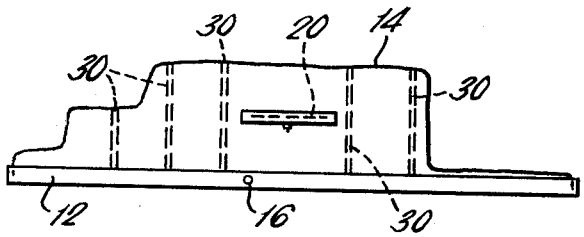
FIG. 1 is a view in side elevation of a container for storage of a vehicle and forming one embodiment of the invention.
Figure 2:
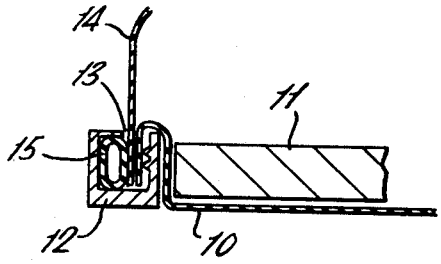
FIG. 2 is a cross-sectional elevation to a much larger scale, through a seal employed around the periphery of the container of FIG. 1.

Referring to FIGS. 1 and 2, there is shown a container for the storage of a vehicle comprising a flexible sheet 10 of impermeable material forming a base for the container and having rigid elements 11 for supporting the wheels of a vehicle. The sheet 10 is sealed in an airtight manner to a rigid rim structure 12 around the periphery of the container and having an endless slot 13 into which is put the peripheral edge of a flexible impermeable cover 14, typically formed of butyl rubber. The cover 14 is sealed into the slot 13 by means of an inflatable tube 15 extending along the length of the slot. This tube 15 may be integral with or attached to the cover or may be separate from the cover, for example, housed within the slot 13.

In use, a vehicle to be stored is driven onto the rigid elements 11 on the base and the cover 14 is then put over the vehicle. The periphery of the cover is tucked into the slot 13 around the whole periphery of the cover and the tube 15 is inflated to effect a seal between the cover and the base. Air is then evacuated from the region within the cover, e.g. through an air outlet valve 16. A small degree of vacuum causes the cover 14 to be sucked down around the vehicle or other goods within the container.

The present invention is concerned more particularly with the provision of access to the vehicle in the container whilst avoiding any necessity for removing the cover 14. This cover has, at a location where access is required, a long slit 20, the edges of the cover on the two sides of the slit constituting lips 21 (FIG. 3) which are sealed together by insertion in a rigid elongate channel 22 or slotted tube which contains an inflatable tube 23 or tubes. The channel 22 is longer than the lips 21 and beyond each end at the lips, the cover 14 is folded and put into the channel. Thus, when the tube 23 is inflated, the two lips 21 are pressed tightly together and pressed against a wall of the channel 22 so sealing the lips together. Preferably longitudinal ribs 24 are provided on the wall to assist in obtaining tight sealing. Inflation of the tube 23 is effected through a one-way valve 25. Only a low pressure is needed and a portable compressor may be employed, connected by a flexible connector 26 to the valve 25. The valve 25 may be manually released when access to the inside of the container is required.

Although a seal using a rigid channel 22 has been described, it would be possible to use a flexible seal, again with an inflated tube, as is described in U.S. Pat. No. 4,028,853.

In order to facilitate working on the vehicle, it may, in some cases, be desired to lift part of the cover sheet 10 away from the vehicle. For this purpose, inflatable tubes 30 may be provided inside the cover sheet, preferably attached to or formed integrally with that sheet. Such tubes, when inflated, tend to straighten and will form a framework lifting part of the cover. Such tubes may be disposed in any of a number of ways; for example, they may extend radially outwardly and downwardly from a centre point or, as shown, they may be arranged to form a number of arches. These tubes are inflated only when it is required to keep the cover lifted for access and, if necessary, an air compressor may be operated for such time as the tubes have to be inflated.

Figure 3:
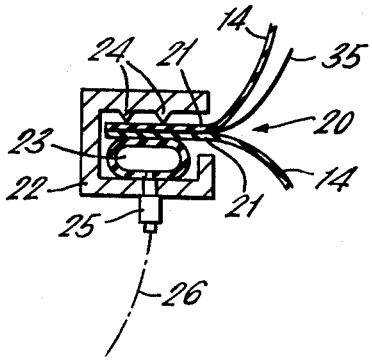
FIG. 3 is a cross-sectional elevation through a sealed access aperture in the container of FIG. 1.

If the cover 10 is made of butyl rubber, it may, in some cases, be desirable to put an inner lining of polyethylene or other sheet material which is more strongly resistant to chemical attack by petroleum products; such a lining is shown at 35 in FIG. 3 and may be sealed into the sealing channel 22. Likewise the base of the container may be lined.

I claim:

1. A container for a vehicle or other goods comprising an impermeable base, an impermeable flexible cover, means for sealing the cover around its periphery to said base and means for evacuating air from the region within said cover, said cover having a closable access opening comprising a slit with an inflatable tube for sealing the two sides of the slit together.

2. A container as claimed in claim 1 wherein the sides of the slit are formed as lips and the inflatable tube is arranged to press the lips together to seal the access opening.

3. A container as claimed in claim 2 wherein a rigid holder is provided for the inflatable tube, the lips being compressed between the tube and a rigid part of the holder.

4. A container as claimed in claim 3 wherein the holder is a channel or slit tube.

5. A container as claimed in claim 1 wherein the base comprises a flexible impermeable sheet, rigid elements for supporting a vehicle and a peripheral channel to which the base sheet is sealed, and having an inflatable tube arranged to seal the periphery of the cover in the channel.

6. A container as claimed in claim 1 wherein the cover is formed of butyl rubber and wherein a liner is provided inside the cover of flexible sheet material more resistant than butyl rubber to attack by petroleum products.

7. A container as claimed in claim 1 and having at least one tube of flexible material inside said cover, said at least one tube being inflatable to form a rigid support for lifting part of the cover.

8. A container for a vehicle comprising an impermeable base having rigid elements for supporting a vehicle and a peripheral channel, a flexible cover of air-impermeable material, means for sealing the periphery of the cover in said peripheral channel, means for evacuating air from the region within the cover whereby the cover is drawn down tightly onto the vehicle on said base, at least one support tube of flexible material inside said cover, means for inflating said at least one support tube to form a rigid support for at least part of the cover, said cover having an access opening comprising a slit in the impermeable material of the cover with openable lips along the two sides of the slit and inflatable means operative to hold the lips in airtight sealing engagement.

* * * * *